US006244810B1

(12) United States Patent
Reyes

(10) Patent No.: US 6,244,810 B1
(45) Date of Patent: Jun. 12, 2001

(54) DRYWALL HANDYMAN

(76) Inventor: Guadalupe Reyes, 8017 S. Rio, Reedley, CA (US) 93654

( * ) Notice: Subject to any disclaimer, the term of this patent is extended or adjusted under 35 U.S.C. 154(b) by 0 days.

(21) Appl. No.: 09/502,364

(22) Filed: Feb. 18, 2000

(51) Int. Cl.[7] ..... B66F 9/12
(52) U.S. Cl. ..... 414/11; 254/4 C
(58) Field of Search ..... 254/3 C, 4 C; 414/11

(56) References Cited

U.S. PATENT DOCUMENTS 3,178,038 * 4/1965 Love ..... 414/11
3,467,261 * 9/1969 Jewell ..... 414/11
4,120,484 * 10/1978 Zimmer ..... 254/6 C
4,300,751 * 11/1981 Delaney ..... 254/2 R
4,600,348 * 7/1986 Pettit ..... 414/11
4,928,916 * 5/1990 Molloy ..... 248/354.1
5,322,403 * 6/1994 Herde ..... 414/11
5,368,429 * 11/1994 Young ..... 414/11
6,010,299 * 1/2000 Jesswein ..... 414/11 X

* cited by examiner

*Primary Examiner*—Janice L. Krizek

(57) ABSTRACT

A new Drywall Handyman for elevating a panel, such as drywall, onto a ceiling at various angles by only one person. The inventive device includes a base member, a telescoping member secured to said base member projecting upwardly, a disc pivotally attached to the telescoping member opposite of the base member, a support member secured to the pivoting assembly allowing coupling to the drywall, a crank pivotally secured within the lower portion of the telescoping-member, a pulley secured to the upper portion of the telescoping member, and a cable engaging the crank projecting through the pulley and engaging the telescoping member to extend the telescoping member.

8 Claims, 4 Drawing Sheets

58
10

52
50
40
42
54
48
44
56
34
41
30
36
60
39
64

20
31
22
74
32
22
20
2
22
22
22

46
44
46
40
49
6
78
6
34
30
76
49
32
30
34
76
32
76
70
72

30

49
32
49
36
49
38
34
49

DRYWALL HANDYMAN

BACKGROUND OF THE INVENTION

1. Field of the Invention

The present invention relates to Panel Lifting Devices and more particularly pertains to a new Drywall Handyman for elevating a panel, such as drywall, onto a ceiling at various angles by only one person.

2. Description of the Prior Art

The use of Panel Lifting Devices is known in the prior art. More specifically, Panel Lifting Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Panel Lifting Devices include U.S. Pat. Nos. 5,322,403; 4,600,348; 4,300,751; 4,482,130; 4,928,916 and 4,120,484.

While these devices fulfill their respective, particular objectives and requirements, the aforementioned patents do not disclose a new Drywall Handyman. The inventive device includes a base member, a telescoping member secured to said base member projecting upwardly, a disc pivotally attached to the telescoping member opposite of the base member, a support member secured to the pivoting means allowing coupling to the drywall, a crank pivotally secured within the lower portion of the telescoping member, a pulley secured to the upper portion of the telescoping member, and a cable engaging the crank projecting through the pulley and engaging the telescoping member to extend the telescoping member.

In these respects, the Drywall Handyman according to the present invention substantially departs from the conventional concepts and designs of the prior art, and in so doing provides an apparatus primarily developed for the purpose of elevating a panel, such as drywall, onto a ceiling at various angles by only one person.

SUMMARY OF THE INVENTION

In view of the foregoing disadvantages inherent in the known types of Panel Lifting Devices now present in the prior art, the present invention provides a new Drywall Handyman construction wherein the same can be utilized for elevating a panel, such as drywall, onto a ceiling at various angles by only one person.

The general purpose of the present invention, which will be described subsequently in greater detail, is to provide a new Drywall Handyman apparatus and method which has many of the advantages of the Panel Lifting Devices mentioned heretofore and many novel features that result in a new Drywall Handyman which is not anticipated, rendered obvious, suggested, or even implied by any of the prior art Panel Lifting Devices, either alone or in any combination thereof.

To attain this, the present invention generally comprises a base member, a telescoping member secured to said base member projecting upwardly, a disc pivotally attached to the telescoping member opposite of the base member, a support member secured to the pivoting means allowing coupling to the drywall, a crank pivotally secured within the lower portion of the telescoping member, a pulley secured to the upper portion of the telescoping member, and a cable engaging the crank projecting through the pulley and engaging the telescoping member to extend the telescoping member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Drywall Handyman apparatus and method which has many of the advantages of the Panel Lifting Devices mentioned heretofore and many novel features that result in a new Drywall Handyman which is not anticipated, rendered obvious, suggested, or even implied by any of the prior art Panel Lifting Devices, either alone or in any combination thereof.

It is another object of the present invention to provide a new Drywall Handyman which may be easily and efficiently manufactured and marketed.

It is a further object of the present invention to provide a new Drywall Handyman which is of a durable and reliable construction.

An even further object of the present invention is to provide a new Drywall Handyman which is susceptible of a low cost of manufacture with regard to both materials and labor, and which accordingly is then susceptible of low prices of sale to the consuming public, thereby making such Drywall Handyman economically available to the buying public.

Still yet another object of the present invention is to provide a new Drywall Handyman which provides in the apparatuses and methods of the prior art some of the advantages thereof, while simultaneously overcoming some of the disadvantages normally associated therewith.

Still another object of the present invention is to provide a new Drywall Handyman for elevating a panel, such as drywall, onto a ceiling at various angles by only one person.

Yet another object of the present invention is to provide a new Drywall Handyman which includes a base member, a telescoping member secured to said base member projecting upwardly, a disc pivotally attached to the telescoping member opposite of the base member, a support member secured to the pivoting means allowing coupling to the drywall, a crank pivotally secured within the lower portion of the telescoping member, a pulley secured to the upper portion of the telescoping member, and a cable engaging the crank projecting through the pulley and engaging the telescoping member to extend the telescoping member.

Still yet another object of the present invention is to provide a new Drywall Handyman that is capable of tilting allowing only one person to load a sheet of drywall onto the support member.

Even still another object of the present invention is to provide a new Drywall Handyman that eliminates the requirement of having more than one person install drywall onto a ceiling.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
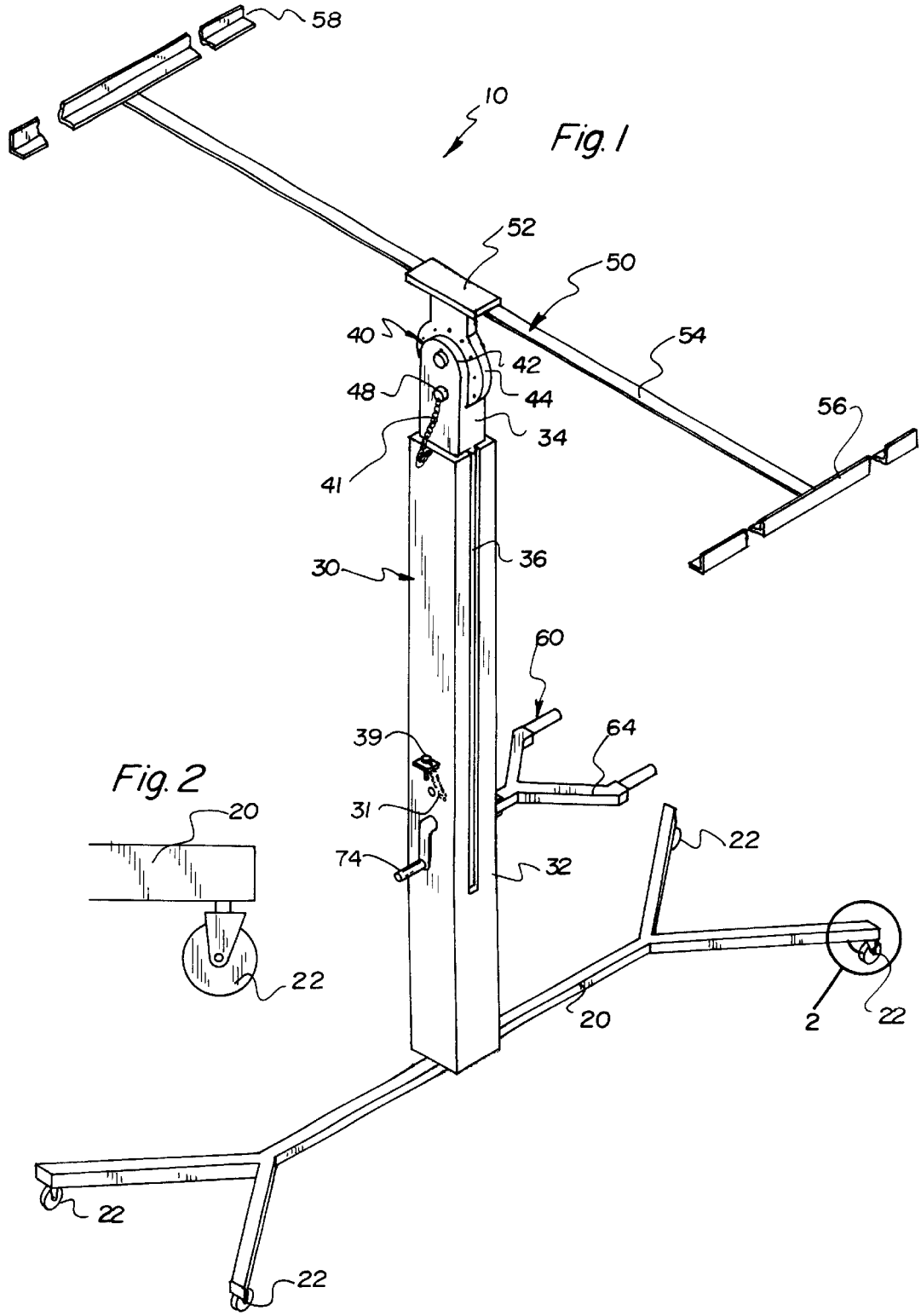
FIG. 1 is an upper side perspective view of a new Drywall Handyman according to the present invention.
FIG. 2 is a magnified side view from FIG. 1 disclosing the swivel wheel.

With reference now to the drawings, and in particular to FIGS. 1 through 6 thereof, a new Drywall Handyman embodying the principles and concepts of the present invention and generally designated by the reference numeral 10 will be described.

More specifically, it will be noted that the Drywall Handyman 10 comprises a base member 20, a telescoping member 30 secured to the base member 20 extending upwardly, a pivoting means 40 secured to the telescoping member 30 opposite of the base member 20, a support member 50 secured to the pivoting means 40, where the support member 50 removably engages a panel, and an elevating means 70 secured within the telescoping member 30 which extends the telescoping member 30 to a desired elevation.

Figure 3:
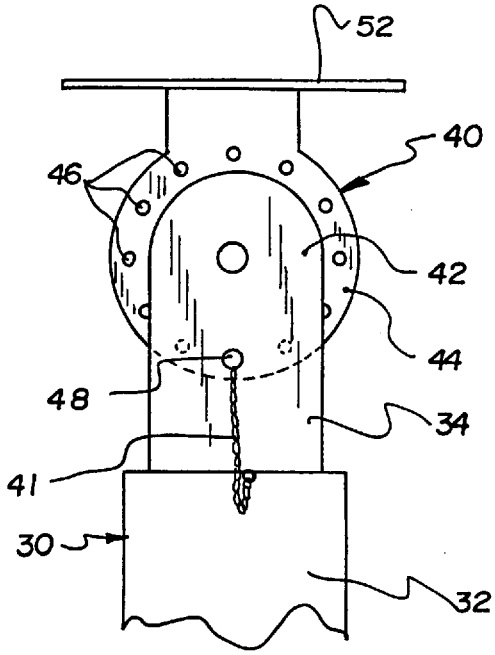
FIG. 3 is a side view of the pivoting means.
Figure 4:
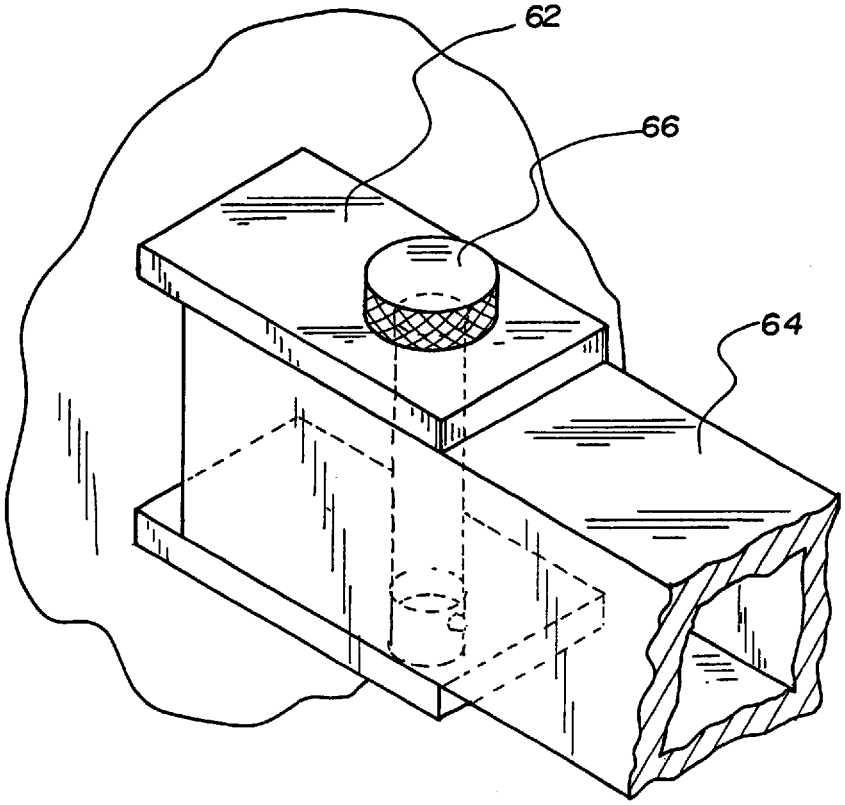
FIG. 4 is a magnified upper perspective view of the handle member.
Figure 5:
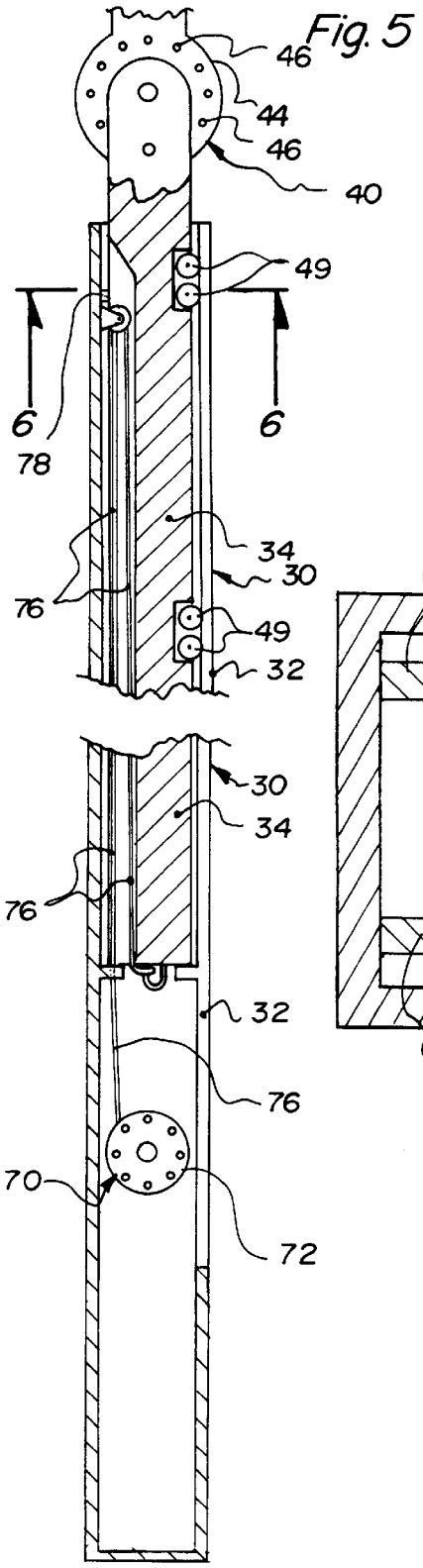
FIG. 5 is a cut away side view of the telescoping member and elevating means.
Figure 6:
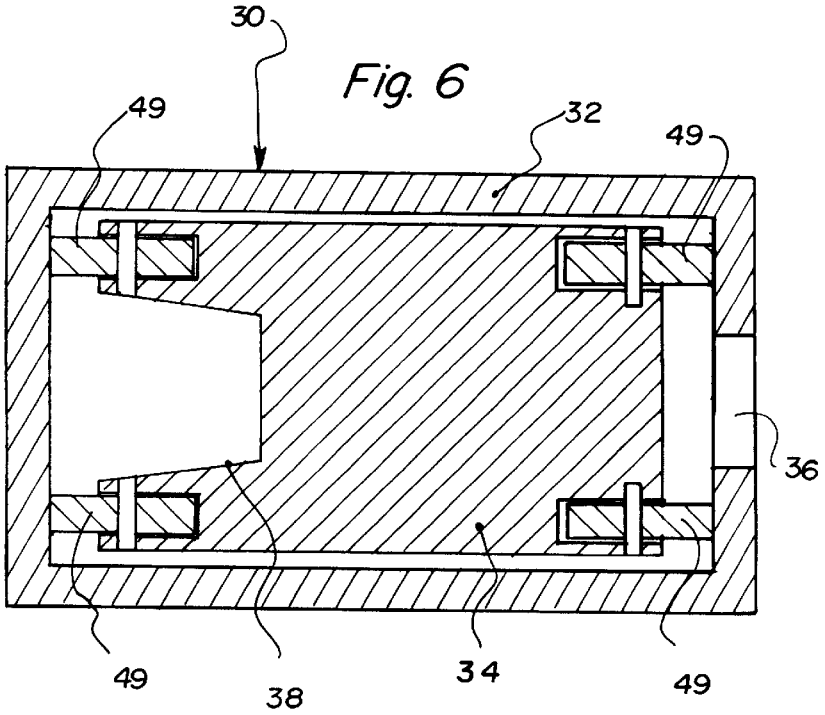
FIG. 6 is a cross sectional view taken along line 6—6 of FIG. 5.

As best illustrated in FIGS. 1 through 7, it can be shown that the telescoping means comprises an elongated exterior tube 32 secured to the base member 20. An elongated interior member 34 is slidably positioned within the exterior tube 32 as best shown in FIGS. 5 and 6 of the drawings. As shown in FIGS. 5 and 6, a plurality of rollers 49 are rotatably secured to the interior member 34 to engage the interior portion of the exterior tube 32. The elevating means 70 has a crank 72 pivotally secured within the lower interior portion of the exterior tube 32 as shown in FIG. 5 of the drawings. The interior member 34 has a cable channel 38 vertically along a side as best shown in FIG. 6. A crank handle 74 is coupled to the crank 72 extending rotatably through the exterior tube 32. A pulley 78 is secured to the upper interior portion of the exterior tube 32 within the cable channel 38 as shown in FIG. 5. As shown in FIG. 5, a cable 76 engages the crank 72 and extends upwardly to engage the pulley 78. The cable 76 thereafter extends downwardly through the cable channel 38 to couple to a bottom end of the interior member 34. The base member 20 preferably has a plurality of swivel wheels 22. A first locking pin 39 removably projects through the upper portion of the exterior tube 32 through the interior member 34. The first locking pin 39 thereby retains the desired elevation of the support member 50.

As best shown in FIGS. 1, 3 and 5, the pivoting means 40 has a U-shaped member 42 secured to the interior member 34 opposite of the cable 76. A disc 44, having a plurality of apertures 46 near the outer perimeter, is pivotally secured within the U-shaped member 42. A second locking pin 48 removably projects through the U-shaped member 42 to selectively engage the desired the aperture, thereby retaining the disc 44 in the desired position.

As best shown in FIG. 1, the support member 50 has a plate 52 secured to the disc 44 horizontally. An elongated member 54 is concentrically coupled to the plate 52. A first angle iron 56 is transversely secured to an end of the elongated member 54. A second angle iron 58 is transversely secured to the elongated member 54 opposite of the first angle iron 56 forming an I-shape.

As best disclosed in FIGS. 1 and 4, a handle member 60 is removably coupled to the exterior tube 32. The handle member 60 has a first member 62 secured orthogonally to the exterior tube 32. A syncline member 64 is removably coupled to the first member 62. A third locking pin 66 is removably projecting through the first member 62 through the syncline member 64 thereby retaining the syncline member 64 to the first member 62.

In use, the user removes the second locking pin 48 allowing pivoting of the support member 50 in a slanted position. The user thereafter positions an unnumbered panel such as drywall onto the support member 50. The support member 50 is pivoted to the desired angle and the second locking pin 48 is positioned into the selected aperture 46 to retain the desired angle of the support member 50. The user thereafter manually manipulates the crank 72 by rotating the crank handle 74 which manipulates the cable 76 to move the interior member 34 either up or down to the desired elevation. The crank 72 is manipulated until the desired elevation is reached with the not shown panel. The user is then able to secure the panel to the ceiling.

Figure 7:
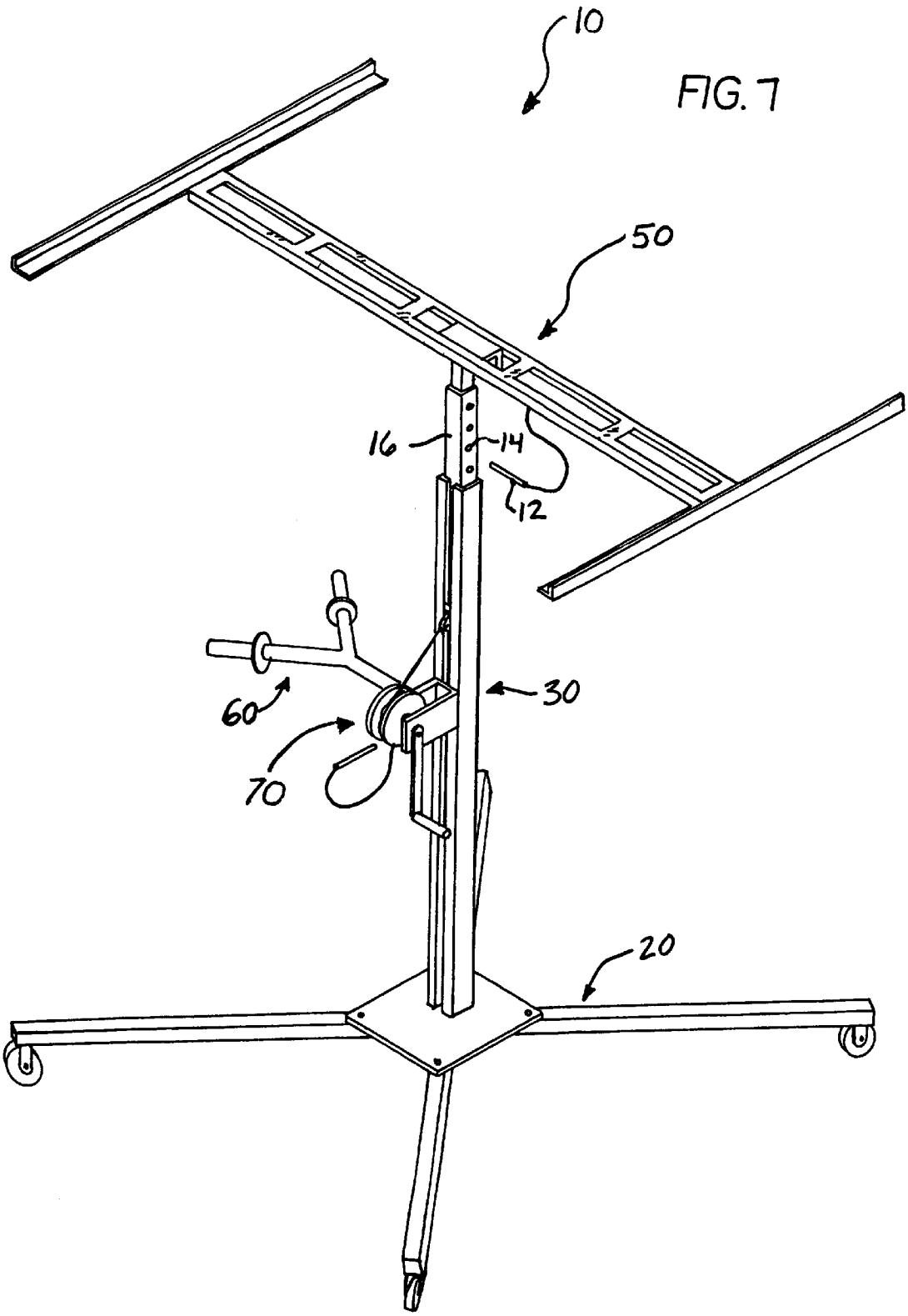
FIG. 7 is a perspective view of an optional embodiment of the invention.

FIG. 7 shows an optional embodiment of the invention wherein the spool of the crank of the elevating means 70 is located on the exterior of the telescoping member 30. Further, a fourth locking pin 12 may be inserted into a number of apertures 14 positioned along the length of the elongated interior member 16.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A drywall support apparatus comprising:

a base member;

a telescoping member secured to said base member extending upwardly;

a pivoting means secured to said telescoping member opposite of said base member;

a support member secured to said pivoting means, where said support member removably engages a panel;

an elevating means secured within said telescoping member which extends said telescoping member to a desired elevation;

an elongated exterior tube secured to said base member; and an elongated interior member slidably positioned within said exterior tube;

a crank pivotally secured within the lower interior portion of said exterior tube;

said interior member including a cable channel extending vertically along a side;

a crank handle coupled to said crank extending rotatably through said exterior tube;

a pulley secured to the upper interior portion of said exterior tube within said cable channel; and a cable engaging said crank extending upwardly and engaging said pulley thereafter extending downwardly through said cable channel to couple to a bottom end of said interior member.

2. The drywall support apparatus of claim 1, wherein a second locking pin removably projects through the upper portion of said exterior tube through said interior member, thereby retaining the desired elevation of said support member.

3. The drywall support apparatus of claim 1, wherein said base member includes a plurality of swivel wheels.

4. The drywall support apparatus of claim 1, wherein a plurality of rollers are rotatably secured to said interior member to engage the interior portion of said exterior tube.

5. The drywall support apparatus of claim 1, wherein said pivoting means comprises:

a U-shaped member secured to said interior member opposite of said cable;

a disc having a plurality of apertures near the outer perimeter, where said disc is pivotally secured within said U-shaped member; and a first locking pin removably projecting through said U-shaped member to selectively engage the desired said aperture, thereby retaining said disc in the desired position.

6. The drywall support apparatus of claim 5, wherein said support member comprises:

a plate secured to said disc;

an elongated member concentrically coupled to said plate;

a first angle member transversely secured to an end of said elongated member; and a second angle member transversely secured to said elongated member opposite of said first angle member.

7. The drywall support apparatus of claim 1, wherein a handle member is removably coupled to said exterior tube.

8. The drywall support apparatus of claim 7, wherein said handle member comprises:

a first member secured orthogonally to said exterior tube;

a syncline member removably coupling to said first member; and a locking pin removably projecting through said first member through said syncline member.

* * * * *